United States Patent [19]

Inoue

[11] Patent Number: 4,986,601

[45] Date of Patent: Jan. 22, 1991

[54] TILTING MECHANISM FOR SUPPORTING SEAT PORTION AND BACKREST OF CHAIR IN INTEGRAL FASHION

[75] Inventor: Noboru Inoue, Tokyo, Japan

[73] Assignee: Itoki Co., Ltd., Osaka, Japan

[21] Appl. No.: 437,101

[22] Filed: Nov. 16, 1989

[30] Foreign Application Priority Data

Nov. 30, 1988 [JP] Japan ..... 63-154864[U]

[51] Int. Cl.[5] ..... A47C 1/032

[52] U.S. Cl. ..... 297/301; 297/320

[58] Field of Search ..... 297/300–302, 297/316, 320

[56] References Cited

U.S. PATENT DOCUMENTS

| | | | |
|---|---|---|---|
| 2,471,024 | 5/1949 | Cramer | 297/301 |
| 4,502,729 | 3/1985 | Locher | 297/301 |
| 4,709,962 | 12/1987 | Steinmann | 297/301 |
| 4,848,837 | 7/1989 | Volkle | 297/301 X |

FOREIGN PATENT DOCUMENTS

| | | | |
|---|---|---|---|
| 240389 | 10/1987 | European Pat. Off. | 297/301 |
| 3605809 | 8/1987 | Fed. Rep. of Germany | 297/301 |

*Primary Examiner*—Peter R. Brown

*Attorney, Agent, or Firm*—Rogers & Killeen

[57] ABSTRACT

A tilting mechamism for supporting a seat portion and a backrest of chair in integral fashion. This mechanism comprising an upright support; a pedestal block mounted on an upper end of the upright support for swivel movement; an arm member pivotally engaged at the rear side thereof by a first horizontal shaft mounted on the pedestal block toward the front of the upright support; a seat plate pivotally engaged at a front portion thereof with the end of this arm member by a second horizontal shaft; an elastic body such as a spring lying between this plate and the block; a backrest supporting member on which a backrest can be mounted, the supporting member being elongated and carried in part on the lower face of the seat plate and pivotally engaged with a long hole formed at the rear end of the seat plate by a third horizontal shaft; the forward part of this supporting member mounted on the pedestal block by the first shaft pivotally engaging the arm member with the block; and a gas spring connecting between a fourth shaft mounted on the front end of this supporting member and the second shaft positioned at the front end of the arm member.

5 Claims, 3 Drawing Sheets

TILTING MECHANISM FOR SUPPORTING SEAT PORTION AND BACKREST OF CHAIR IN INTEGRAL FASHION

BACKGROUND OF THE INVENTION

1. Field of the Invention

The present invention relates generally to tilting mechanisms suitable for use with chairs such as office chairs and, more particularly, to tilting mechanisms for the seat portions of such chairs as well as an interlocking tilting mechanism for supporting the seat portions to allow integral movement with the backrest.

2. Description of the Related Art

Recently, in the chairs used in the office many mechanisms which interlockingly tilt a seat portion with its backrest have been proposed and some of them are now in use.

However, most of the conventionally proposed interlocking mechanisms that tilt the seat portion together with the backrest, are arranged so that when the seat portion is sunk by the weight of the person using the chair the backrest leans backward and interlocks, or so that when a person leans into the backrest the seat portion sinks interlockingly at the same time that the backrest leans backward.

However, the posture with which a person sits on an office chair is not limited to a posture which can be coped with by the conventional interlocking mechanisms. For example, a person may sit on the chair while distributing his weight so that the front side of the seat portion sinks to its forward side.

In this case, there are problems in (1) that the chairs do not cope with the posture with the conventional interlocking mechanisms, (2) the forming cost of the constituent members is high, (3) there is a troublesome fabrication, or (4) a rough action is induced because of their complex structure even if an interlocking mechanism is installed.

In addition, the feeling of sitting on the chair becomes unpleasant because the abdominal region of the person sitting is compressed when he sits on the chair with a slouching posture if the seat portion is not sunk and forward.

SUMMARY OF THE INVENTION

A tilting mechanism for supporting a seat portion and a backrest of a chair in integral fashion. This mechanism comprising an upright support; a pedestal block mounted on an upper end of the upright support for swivel movement; an arm member pivotally engaged at the rear side thereof by a horizontal shaft mounted on the pedestal block toward the front of the upright support; a seat plate pivotally engaged at a front portion thereof with the end of this arm member by a second horizontal shaft; an elastic body such as a spring lying between this plate and the block; a backrest supporting member on which a backrest can be mounted, the supporting member being elongated and carried in part on the lower face of the seat plate and pivotally engaged with a long hole formed at the rear end of the seat plate by a third horizontal shaft; the forward part of this supporting member mounted on the pedestal block by the first shaft pivotally engaging the arm member with the block; and a gas spring connecting between a fourth shaft mounted on the front end of this supporting member and the second shaft positioned at the front end of the arm member.

It is therefore an object of the present invention to provide a tilting mechanism without the aforementioned problems. According to the present invention, this object is accomplished by providing a tilting mechanism for supporting the seat portion and backrest of a chair in integral fashion, comprising an upright support; a pedestal block mounted on an upper end of the upright support for swivel movement; an arm member pivotally engaged at the rear side thereof by a first horizontal shaft mounted on the pedestal block toward the front of the upright support; a seat plate pivotally engaged at one of its ends with the end of the arm member by a second horizontal shaft; an elastic body, such as a spring, lying between the seat plate and the block; a backrest supporting member on which a backrest can be mounted, the supporting member being elongated and carried on the lower face of the seat plate and pivotally engaged with a long hole formed at the rear end of the seat plate by a third horizontal shaft; the forward part of the backrest supporting member being mounted on the pedestal block by the first shaft pivotally engaging the arm member with the block; and a gas spring connecting between a fourth shaft mounted on the front end of the backrest supporting member and the second shaft positioned at the front end of the arm member.

The seat plate can tilt vertically both forward and backward of the first shaft because it is installed by the second shaft at the front end of the arm member and tiltably engaged with the pedestal block by the first shaft.

The seat plate and the backrest supporting member each tilt interlockingly with the tilting of the other since the backrest supporting member pivotally engaged with the pedestal block by the first shaft for common use is connected with the seat plate at the front and rear parts of the seat plate through the long hole, second, third and fourth shafts and the gas spring.

These and other objects, features and advantages of the present invention will become apparent from the following detailed description of a preferred embodiment thereof taken in conjunction with the accompanying drawings.

DESCRIPTION OF THE PREFERRED EMBODIMENTS

Figure 1:
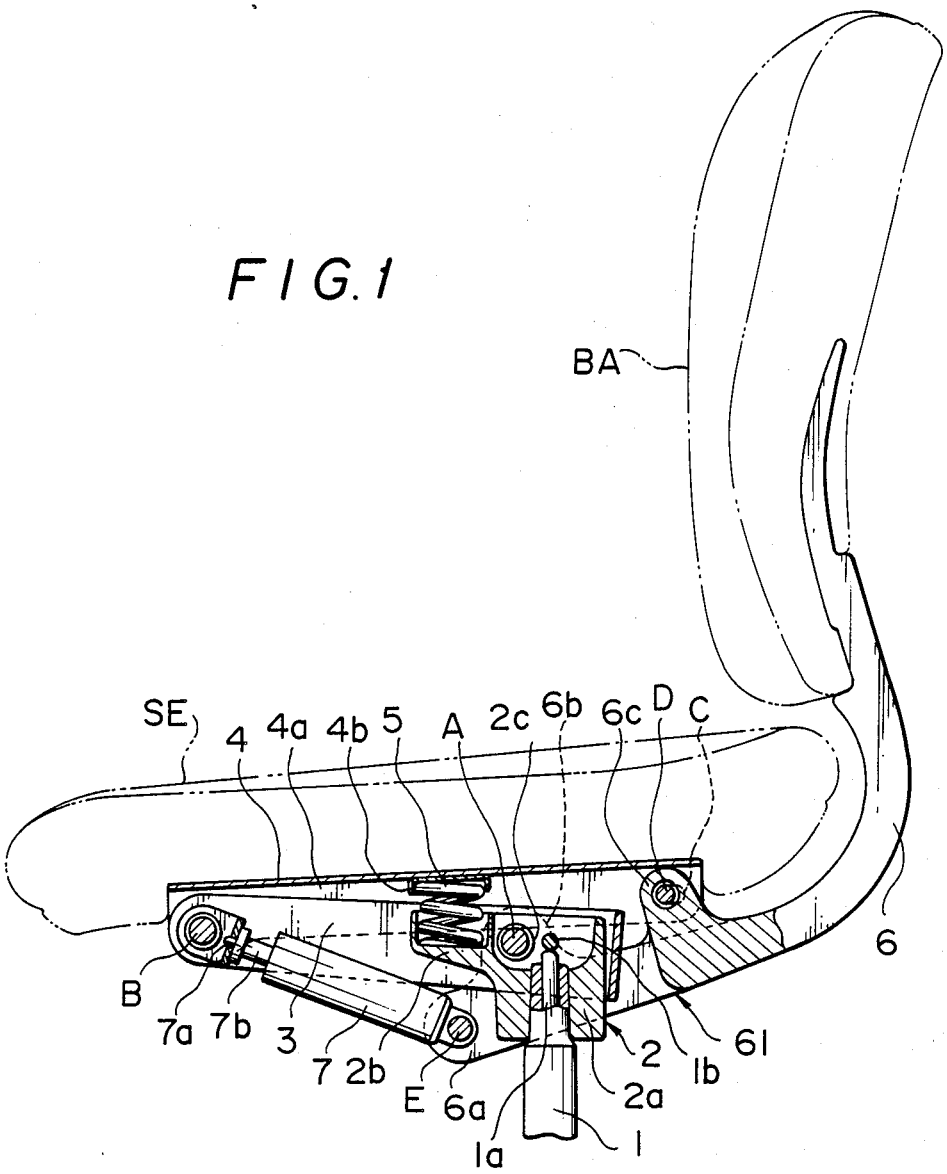
FIG. 1 is a diagrammatic side elevation in cross section of a preferred embodiment of a mechanism of the present invention in the state in which no weight is loaded.
Figure 2:
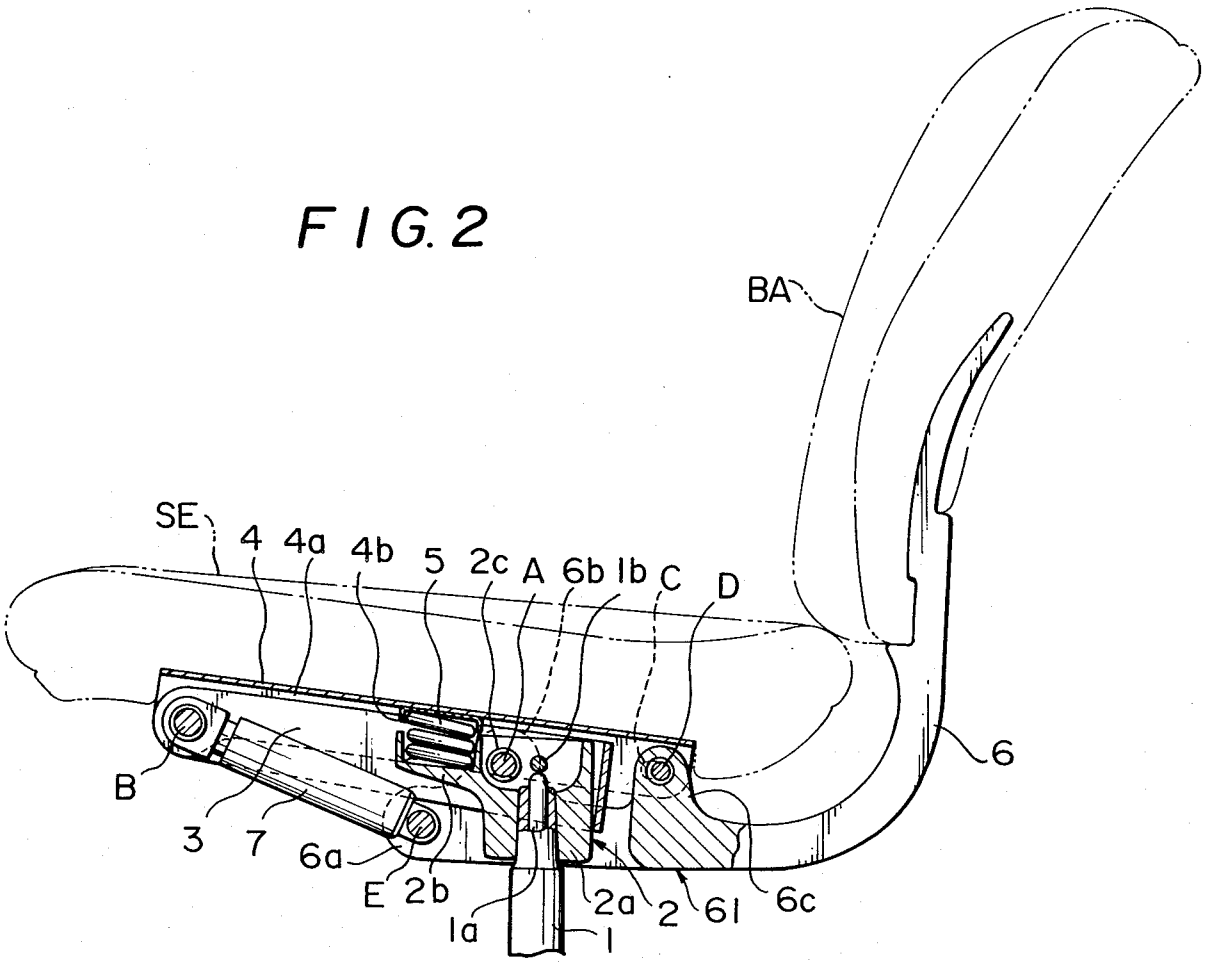
FIG. 2 is a diagrammatic side elevation in cross section of a preferred embodiment of a mechanism of the present invention in the state in which a seat plate is most sunken and the backrest supporting member is tilted farthest backward.
Figure 3:
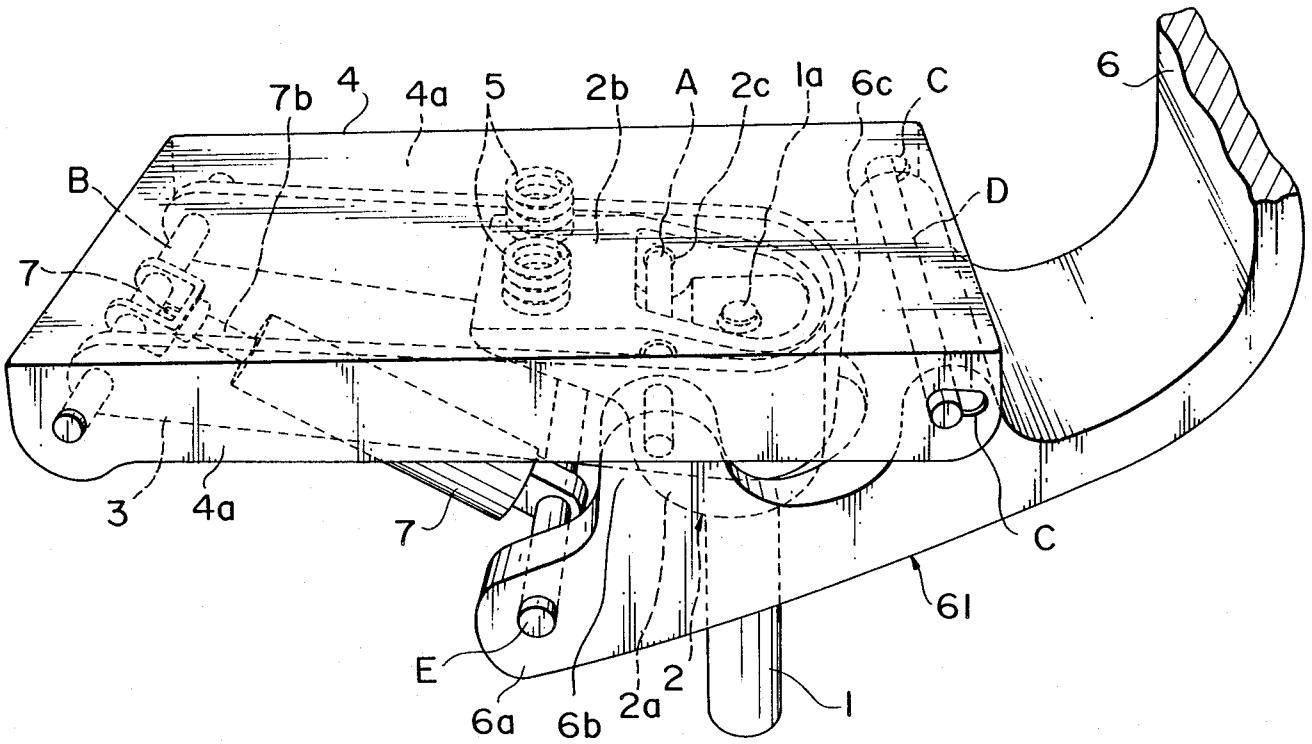
FIG. 3 is a diagrammatic perspective view of the whole mechanism of the present invention.

In the drawings, an upright support in the same pole shape as that for a common swivel chair typically used in an office is indicated as 1, and the gas spring (which does not appear in the figure) incorporated in the upright support makes it possible to change its height within a specified range. A valve rod la opening and shutting the valve of this gas spring and an operating lever 1b pushing down this valve rod 1a are shown as the cross sections.

A pedestal block 2, in block shape mounted on the upper end of said upright support 1, forms a pedestal 2b in plate-like shape in front of the body 2a and a horizontal bearing 2c in a direction parallel to that of the width of a pedestal plate 4 in front of the central axis of the upright support 1.

An arm member 3 formed in U (or hairpin) shape in a horizontal plane. While this arm member 3 is pivotally mounted on said block 2 by a shaft A, it is positioned so that the bent-up rear end side covers the block 2, and its open ends are pivotally engaged with the front end of a seat plate 4 (which is described later) by a shaft B.

The seat plate 4 is a plain plate on which a seat sheet SE is mounted and side walls 4a are formed on both sides when viewed from the front. The front end of the side walls 4a are pivotally engaged with the front end of said arm member 3 with a shaft B, and a long hole C is formed at the rear end of the side walls 4a. This long hole is pivotally engaged with a supporting member 6 of a backrest BA, which is described later, with a shaft D.

An upper pedestal 4b is formed at the part corresponding to the lower pedestal 2b of the pedestal block 2 on the lower face of aforementioned seat plate 4. A coil spring 5 is installed between both upper pedestals 4b and lower pedestal 2b in the example of this figure. Another type of spring or elastic body such as a rubber band and so on may be installed instead of this spring 5.

A supporting member 6 is shown on which a backrest BA is mounted. Its lower side is bent and elongated so that it can be positioned on the lower face of the seat plate 4 and the end side of an elongated part 61 of this supporting member 6 is formed as sheared-leg shape so that the pedestal block 2 or the arm member 3 can be put between the elongated part 61.

The connecting projecting parts 6a, 6a and 6c are formed on the upper face of the elongated part 61 of this member 6 in order to connect with another member in this embodiment of the figure.

While said supporting member 6 is pivotally engaged with the connecting projecting part 6b by the shaft A of the pedestal block 2, the connecting projecting part 6c positioned at the rear end of said supporting member 6 is connected with a long hole C of the seat plate 4 by a shaft D. Supporting member 6 is interconnectically installed on the pedestal block 2 and the seat plate 4 by connecting a gas spring 7 between a shaft E mounted on the projecting part 6a of the front end and the shaft B connecting the seat plate 4 with the arm member 3.

The gas spring 7 can adjust the rate of projection of a rod 7b which peeps out from the cylinder by controlling the opening and shutting of a regulating valve 7a. It can be also controlled by installing a coil spring in which a resiliency controlling mechanism is added in the shafts E and B instead of this gas spring.

The mechanism of this invention thus constructed works as follows.

When a person sits on the seat sheet SE, the weight of the person is applied as a load to the seat plate 4 containing the seat sheet SE and supported by pedestal 2b of the pedestal block 2 through the spring 5.

While the weight near the center point of the seat plate is supported by the pedestal 2b through the spring 5 in this condition, the front end of this plate 4 is connected with the front end of the arm member 3, which is supported by the block 2 at the front end thereof through the shaft A, and the rear end of the seat plate 4 is connected with the connecting projecting part 6c of the backrest supporting member 6, which is supported by the pedestal block 2 by the shaft A. Therefore, the seat plate 4 can be rocked in the sinking direction of the seat plate 4 at the forward and backward edges of the plate 4 round a shaft A.

Since the front end of this plate 4 is connected with the connecting projecting part 6a formed at the front end of the backrest supporting member 6 through the gas spring 7 and the rear end of the seat plate 4 is connected with the connecting projecting part 6c of the backrest supporting member 6 through the long hole C and the shaft D, this sinking at the forward and backward edges of the plate 4 is accompanied by the forward and backward inclining movement of the supporting member 6 on which the backrest BA is mounted.

When the seat plate sinks at the front end side, this sinking action induces the rise of the rear part of the plate 4 round the shaft A co-operating with the arm member 3 at the same time that the sinking action pushes the connecting projecting part 6a of the end of the backrest supporting member 6 backward through the gas spring 7. When this supporting member 6 is pushed from the front side, this sinking action is converted into a counter-clockwise angular rotation because this supporting member is pivotally engaged with the shaft A. This counter-clockwise angular rotation synchronizes with the rise of the rear part of the plate 4 at the long hole C and the shaft D which connects them.

On the other hand, when the seat plate 4 sinks at the rear end side thereof, this sinking action works round the shaft B of the arm member 3 and induces the synchronized backward leaning action of this supporting member 6.

At this time the plate 4 leans backward round the shaft B because the rear end wall 3a of the arm member 3 strikes the rear face of the body 2a of the pedestal block 2 and inhibits the counter-clockwise angular rotation of the arm member 3 round the shaft A.

The above mentioned synchronous action is also induced by the sinking of the rear side of the seat plate 4 when the backrest supporting member is leant backward.

For the constituent mechanical members of this invention which are shown in the aforementioned description, ready-made articles are used as the coil spring 5 and the gas spring 7. In addition, since the shapes of the upright support 1, pedestal block 2, arm member 3, seat plate 4, backrest supporting member 6 and so on, are simple, these member can be manufactured easily by casting and forging of metals, press working of sheet metal and so on, or by the forming of synthetic resin.

As described above, there are advantages in tilting of the seat plate corresponding to the posture of the person who sits on it and in interlocking by tilting the backrest, and the tilting of the seat plate corresponding and interlocking to the tilting of the backrest can be accomplished smoothly because the seat plate is formed to be able to tilt both forward and backward and the supporting member on which the backrest is mounted is connected with this seat plate so that the supporting member acts interlockingly with that of the seat plate. A further advantage relates to manufacturing the mechanism in that the components have a simple structure and the number of members is relatively small.

Therefore, the present invention offers significant utility as a tilting mechanism interlockingly sinking of the seat plate with the tilting of the backrest for use with office chair.

What is claimed is:

1. A tilting mechanism for supporting a seat portion that extends forwardly and a backrest of a chair in integral fashion, comprising:

an upright support;

a pedestal block for swivel movement mounted on the upper end of said upright support;

an arm member having a rear end pivotally engaged with said pedestal block by a first horizontal shaft carried forwardly of said upright support;

a seat plate having a front portion pivotally engaged with a front end of said arm member by a second horizontal shaft;

an elastic body lying between said seat plate and said pedestal block;

a backrest supporting member on which a backrest can be mounted, carried in part below said seat plate, said backrest supporting member being pivotally engaged at a rearwardly extending portion with a rear portion of said seat plate by a third horizontal shaft carried in an oblong hole in said seat plate and pivotably engaged at a forwardly extending portion with said pedestal block by said first horizontal shaft; and a gas spring 7 connecting between a fourth shaft mounted on a front end of said backrest supporting member and said second horizontal shaft.

2. A tilting mechanism for supporting a forwardly extending seat and upwardly extending backrest of a chair having an upright support, comprising:

a pedestal block rotatably carried by the upper portion of said upright support;

an arm member having a rear end pivotably engaged with said pedestal block by a first shaft carried forwardly of said upright support;

a seat plate for carrying the seat, having a front portion pivotally engaged with a front end of said arm member by a second shaft;

a backrest supporting member for carrying the backrest, having a rearwardly extending portion pivotably engaged with a rear portion of said seat plate by a third shaft carried in an oblong hole in said seat plate and a forwardly extending portion pivotably engaged with said first shaft; and spring means pivotably engaged with said second shaft and with said backrest supporting member by a fourth shaft positioned forwardly of said first shaft.

3. The mechanism as defined in claim 2 wherein said backrest supporting member bifurates rearwardly of said upright support and has two members extending forwardly thereof.

4. The mechanism as defined in claim 2 wherein said oblong hole has a major axis extending generally horizontally.

5. The mechanism as defined in claim 2 wherein said arm member is U-shaped, with said pedestal block positioned therein and with two arms extending forwardly of said pedestal block.

* * * * *